United States Patent [19]

Fowler et al.

[11] Patent Number: 4,858,890

[45] Date of Patent: Aug. 22, 1989

[54] METHOD AND APPARATUS FOR LIFTING OBJECTS INSIDE A LIMITED ACCESS VESSEL

[75] Inventors: Ronald E. Fowler, Long Grove; Jeffrey L. Voss, Elgin, both of Ill.; Stephen D. Cain, Canton, Ga.

[73] Assignee: Brand Scaffold Services, Ltd., Park Ridge, Ill.

[21] Appl. No.: 160,530

[22] Filed: Feb. 26, 1988

[51] Int. Cl.[4] ..... B66C 23/30; B66D 1/12; B66D 3/20

[52] U.S. Cl. ..... 254/335; 52/79.6; 212/179; 254/326; 254/362; 254/382

[58] Field of Search ..... 254/266, 283, 284, 285, 254/323, 325, 326, 327, 334, 335, 336, 337, 338, 362, 382; 414/626; 212/175, 179; 52/73, 79.6, 122.1, 124.2, 125.2

[56] References Cited

U.S. PATENT DOCUMENTS

| | | | |
|---|---|---|---|
| 2,623,643 | 12/1952 | Seamans | 212/179 |
| 2,700,481 | 1/1955 | Donatelli | 254/362 X |
| 3,242,894 | 3/1966 | Anderson | 254/266 X |
| 3,391,906 | 7/1968 | Duerst | 254/336 X |
| 3,450,386 | 6/1969 | Eliel | 254/326 X |
| 3,978,989 | 9/1976 | Avila | 212/179 X |

FOREIGN PATENT DOCUMENTS

| | | | |
|---|---|---|---|
| 241067 | 7/1965 | Austria | 254/338 |
| 28876 | 6/1957 | Finland | 254/325 |
| 585649 | 2/1947 | United Kingdom | 254/283 |

*Primary Examiner*—Joseph J. Hail, III

*Attorney, Agent, or Firm*—Dressler, Goldsmith, Shore, Sutker & Milnamow, Ltd.

[57] ABSTRACT

A hoist and method are provided for lifting objects inside a vessel having a wall defining a port and having a platform on the exterior of the wall. The hoist includes a frame with a support portion extending outwardly from the port adjacent the platform and a cantilevered portion for extending through, and inwardly from, the port. A suitable clamping system is provided for clamping the frame support portion to the platform. A hoist cable is provided along the frame from the support portion to the cantilevered portion and extends over a sheave at the end of the cantilevered portion so that it hangs down inside the vessel. A winch is operatively engaged with the hoist cable and is mounted to the frame support portion for feeding out and retracting the cable whereby the end of the cable may be raised and lowered inside the vessel.

2 Claims, 3 Drawing Sheets

METHOD AND APPARATUS FOR LIFTING OBJECTS INSIDE A LIMITED ACCESS VESSEL

TECHNICAL FIELD

This invention relates to apparatus and methods for lifting objects inside a confined, limited-access area.

BACKGROUND OF THE INVENTION AND TECHNICAL PROBLEMS POSED BY THE PRIOR ART

Various types of industrial facilities have boilers or vessels which are relatively large. Workers may have to enter the interiors of such vessels to engage in construction, repair, inspection, or testing. Vessels in which such work may be performed are found in fossel-fueled electric generating power plants, refineries, pulp mills, and other industrial facilities.

The work performed inside such a vessel may require the use of various tools, machines, and construction materials which must be moved into, and among various locations within, the vessel. Frequently, scaffolding must also be built up in the interior of the vessel.

Many types of vessels have large access ports through which larger tools, instruments, and materials can be passed, and these ports are usually located relatively low in the vessel. Thus, objects brought into the vessel through such access ports must then be raised to the higher elevations within the vessel.

Although such vessels may have auxiliary ports in the upper elevations, these higher ports, which may be used for inspection or other purposes, are typically relatively small (e.g., as small as 3″by 5″). Thus, most larger pieces of apparatus and material cannot be passed through such small ports.

The raising of larger objects from the bottom of the vessel interior to the upper elevations where that object is used has conventionally been effected by manually lifting the object in a bucket-brigade fashion up a scaffolding on the interior of the vessel. This is obviously very labor-intensive, and can be dangerous with heavy objects. Further, the final, precise positioning of the object at the higher elevation is difficult to control manually if the object is relatively heavy.

Accordingly, it would be desirable to provide an apparatus and method for supplying objects to the upper elevations of a vessel interior. It would be beneficial if an apparatus could be provided for lifting such an object to the precise elevation where it is needed. In addition, it would be advantageous if the apparatus could be large enough, and have enough power, to lift relatively heavy objects. It would further be desirable if such an apparatus could be designed to function as described even though the apparatus may be too large or heavy to permit installation of the entire apparatus inside of the vessel. Finally, it would be beneficial if such an apparatus could be controlled by workers inside the vessel.

SUMMARY OF THE INVENTION

A hoist is provided for lifting an object from a lower elevation to a higher elevation inside a vessel that has a wall defining ports above the higher elevation and that has a platform on the exterior of the wall.

The hoist includes a frame which has a support portion for extending outwardly from the port adjacent the platform and which has a cantilevered portion for extending through, and inwardly from, the port when the hoist is operatively disposed to lift objects inside the vessel.

The hoist includes means, such as suitable clamps, for attaching the frame support portion to the platform.

The hoist also includes a hoist cable extending along the frame from the support portion to the cantilevered portion. A sheave, or similar means, is provided on the hoist for guiding the hoist cable through a change in direction on the cantilevered portion to accommodate the hanging of an end of the cable from the cantilevered portion.

A winch is operatively engaged with the hoist cable and is mounted to the frame support portion for feeding out and for retracting the cable whereby the end of the cable may be raised and lowered inside the vessel.

According to the method of the present invention, the hoist is initially positioned with its cantilevered portion extending through one of the ports. The support portion is releasably anchored to the platform adjacent the wall of the vessel.

A winch control cable is fed through one of the ports to the lower elevation in the interior of the vessel. The winch is operated by the control cable from inside the vessel to lower the hoist cable to the lower elevation for attaching an object to the hoist cable. The hoist may then be operated through the control cable to lift the object to the higher elevation.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the use of the invention. The invention is not intended to be limited to the embodiments so illustrated, and the scope of the invention will be pointed out in the appended claims.

Figure 1:
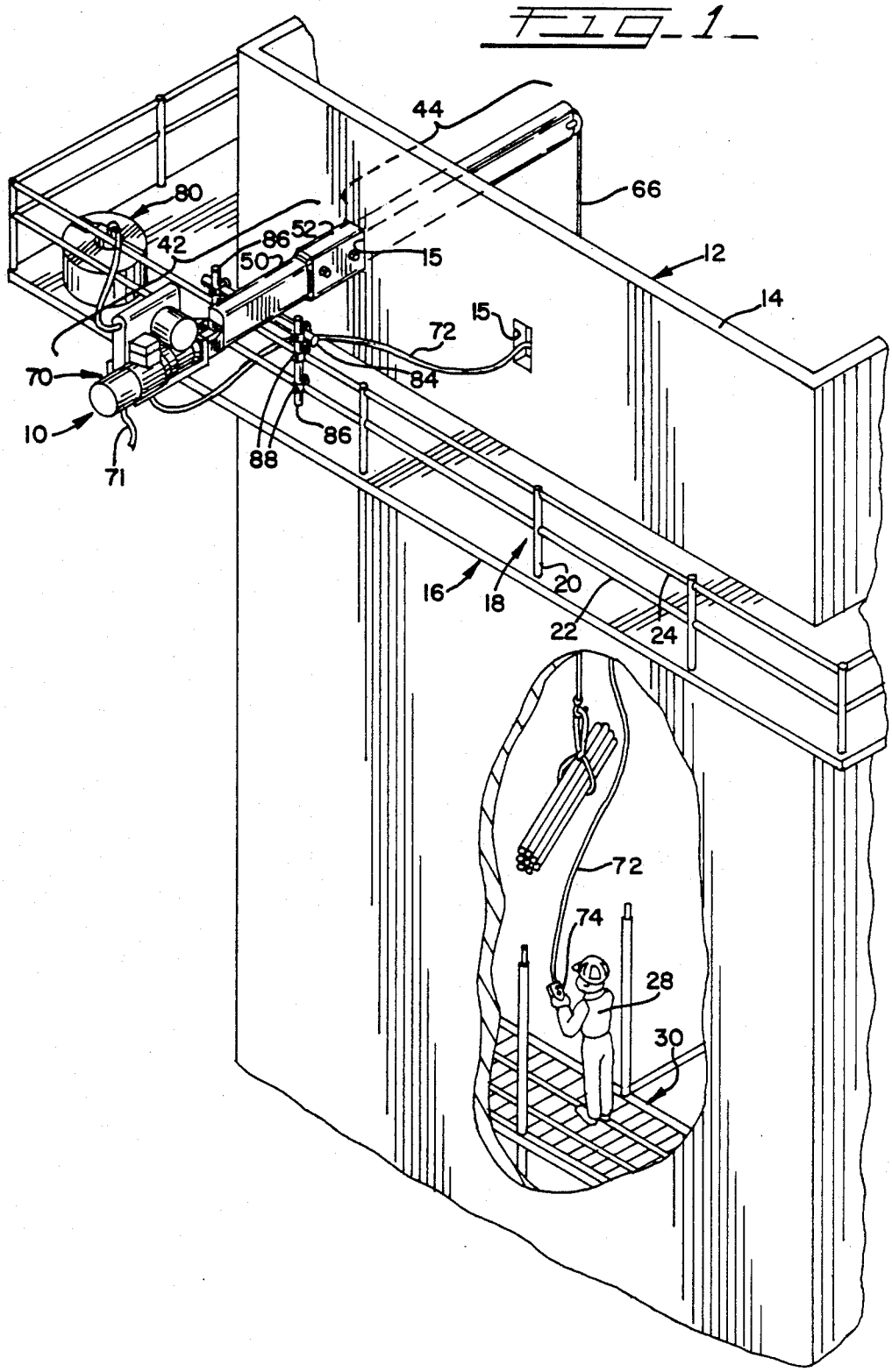
FIG. 1 is a fragmentary, perspective view of the hoist of the present invention shown disposed through the wall of a vessel which has been cut away to better illustrate interior detail.

The hoist is designated generally by the reference numeral 10 in FIG. 1 where the hoist 10 is shown in operation on a large vessel 12. The vessel 12 may be a conventional fossil fuel boiler in an electric power generating plant. The boiler 12 includes a wall 14 which defines small access or inspection ports 15 at the upper elevations of the vessel 12.

Typically, the vessel 12 includes a platform 16, such as a structural member, equipment support member, walkway, grating, or the like. The platform 16 illustrated in FIG. 1 functions as a walkway for workers using the ports 15. The platform 16 includes a conventional hand rail assembly 18 which comprises upstanding posts 20, a lower horizontal rail 22, and an upper horizontal rail 24.

As best illustrated in FIG. 1, a worker 28 may work in the vessel interior on structural support assemblies 30 which, depending upon the type of vessel, may be permanent or may be temporary scaffolding. Typically, the worker enters the vessel interior through a larger access port (not illustrated) in the lower elevation of the vessel 12. The worker brings large objects, including machines, tools, and construction materials, into the vessel interior through such larger ports.

According to the present invention, the hoist 10 is disposed so that a portion of it projects through one of the small access ports (which may be 3"×5" in a conventional boiler). The hoist 10 is initially carried to the higher elevation on the outside of the vessel 12. It may be hoisted into place by external cranes or mechanisms (not illustrated) and/or ma be carried by hand. To facilitate placement at the desired elevation in a vessel wall, the hoist 10 is preferably fabricated in a number of separate pieces that can be relatively easily assembled at the ultimate operation location.

As best illustrated in FIGS. 2–6, the hoist 10 has a frame 40 that includes a support portion 42 for extending outwardly from the port adjacent the platform 16 (FIG. 1) and that includes a cantilevered portion 44 that extends through, and inwardly from, the inspection port 15.

Figures 2, 3, 4, 5, 6:
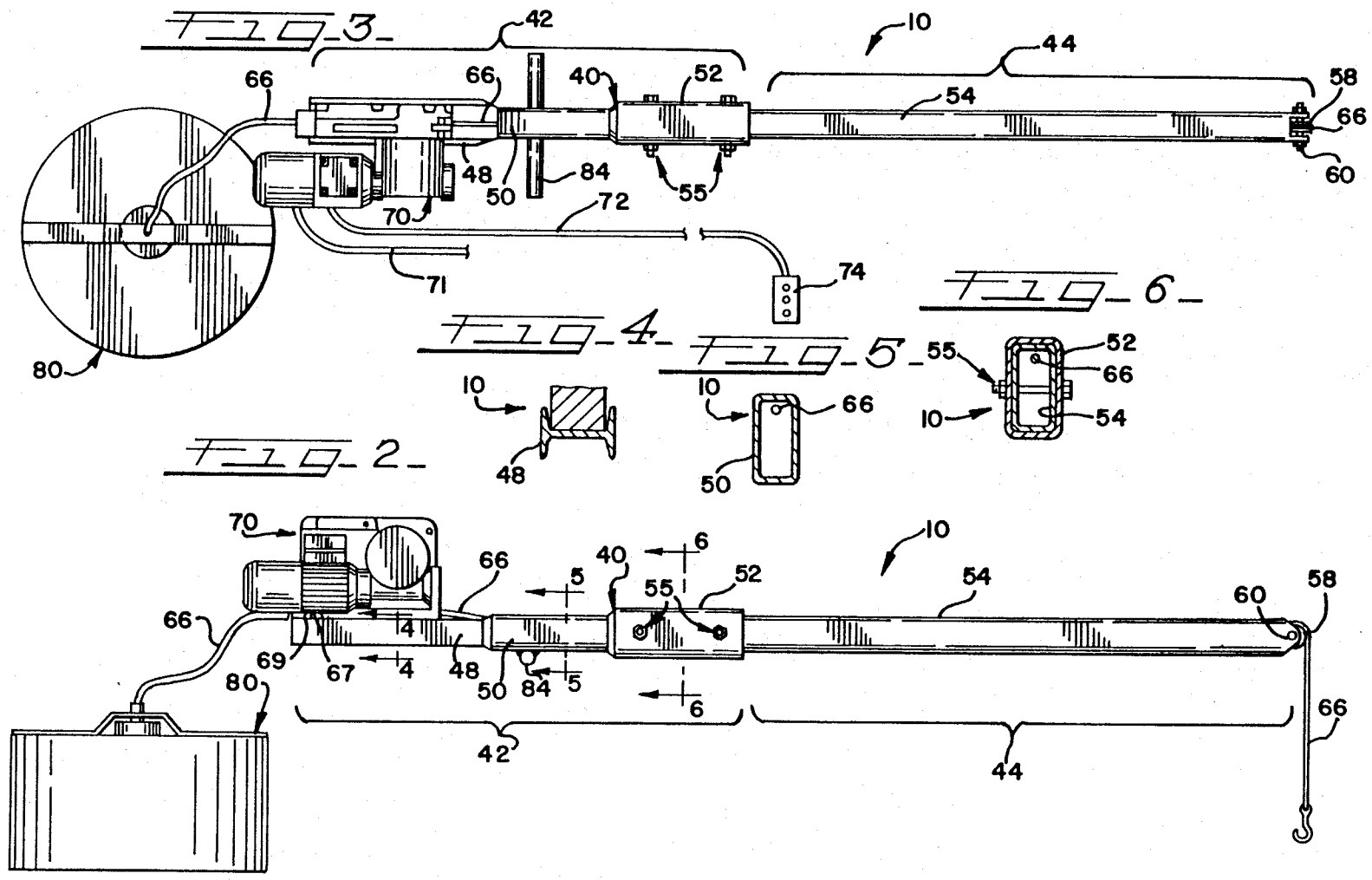
FIG. 2 is a side view of the hoist of the present invention.
FIG. 3 is a plan view of the hoist of the present invention.
FIG. 4 is an enlarged, fragmentary, cross-sectional view taken generally along the plane 4—4 in FIG. 2.
FIG. 5 is an enlarged, cross-sectional view taken generally along the plane 5—5 in FIG. 2.
FIG. 6 is an enlarged, cross-sectional view taken generally along the plane 6—6 in FIG. 2.

As best illustrated in FIG. 4, the end of the support portion 42 includes a wide flange beam 48 which is connected to a first, hollow entry tube 50 (FIG. 5). The first, hollow entry tube 50 is connected to a second, and larger, hollow entry tube 52. Aligned with the tube 50, and received within the tube 52, is the distal end of a hollow exit tube 54 (FIG. 6) which forms part of the cantilevered portion 44. The end of the cantilevered portion 44 includes a sheave 58 which is mounted for rotation to a shaft or bushing 60 carried at the end of the tube 54.

A hoist lifting cable 66 is threaded from one end of the hoist 10 to the other. Specifically, the cable 66 extends from the support portion 42 through the entry tubes 50 and 52 into the exit tube 54. The cable 66 is guided by the sheave 58 through a change in direction to accommodate the hanging of the cable 66 from the cantilevered portion 44 of the hoist 10.

The exit tube 54 has a generally rectangular peripheral configuration for being disposed within a rectangular inspection or access port 15 in the wall 14 of the vessel 12 (as best illustrated in FIG. 1). In the embodiment illustrated, the exit tube 54 has nominal cross-section dimensions of 4"×2". One end of the exit tube 54 is adapted to be telescopically disposed within the entry tube 52 (as best illustrated in FIG. 6). The exit tube 54 and entry tube 52 are releasably secured together by means of a pair of conventional nut and bolt assemblies 55.

A winch 70 is operatively engaged with the cable 66 and is mounted to the wide flange 48 of the frame support portion 42.

The winch 70 may be mounted with an anchor pin 67 which is received in a bore in an anchor lug 69 which is mounted to the member 48 as best illustrated in FIG. 2.

The winch 70 is operable for feeding out and for retracting the cable 66 whereby the end of the cable 66 may be raised and lowered inside the vessel 12. In one preferred form of the invention illustrated, the winch 70 may be a motorized traction device sold under the trade name GRIPWINCH Model 6412M by Griphoist, Inc., 392 University Avenue, Westwood, Maine 02090 U.S.A.

The cable 66 is preferably supplied to the winch 70 from a suitable supply and slack storage device, such as a reel or winder 80. One such device 80 that may be employed is the winder sold under the trade name Acme Cable Winder Model 1000.

The detailed designs and specific structures of the winch 70 and winder 80 employed with the hoist 10 described herein form no part of the present invention.

The winch 70 is provided with electric power from a power cable 71 (FIGS. 1 and 3). The winch 70 is connected through the power cable 71 to a suitable source of electrical energy.

The winch 70 includes a control cable 72 which terminates in a control box or pendant 74 (FIGS. 1 and 3).

The control cable 72 and pendant 74 are fed into the interior of the vessel 12 (typically through one of the access or inspection ports 15) to a lower elevation in the vessel 12 where it can be operated by a worker 28 to control the winch 70.

The hoist 10 is preferably provided with means for facilitating its mounting to the vessel. In particular, a round bar 84 is attached to the bottom of the support portion tube 50 and extends laterally on each side of the tube 50. The bar 84 can be clamped to a suitable structure on the exterior of the vessel 12. As illustrated in FIG. 1, the bar 84 is clamped via clamp devices 88 to two vertically disposed bars 86 which are in turn connected via clamp devices 88 to the horizontal hand rail bars 22 and 24. Any suitable clamp device 88 may be employed, such as the right angle clamp sold under the trade name TUBLOX. The detailed design and specific structure of the clamp devices 88 form no part of the present invention.

The hoist 10 is typically prepared for operation by transporting the components to the desired location on the exterior of the vessel 12. The extension portion tube 54 is then inserted into the distal end opening of the tube 52 on the support portion 42. The cable 66 is threaded over the pulley and through the interior of the tubing into the mechanism of the winch 70. From the winch 70, the cable 66 is fed into the cable winding device 80 which accommodates excess cable during take-up and holds the supply of cable for feed-out.

The cantilevered portion exit tube 54 is then inserted through a convenient inspection or access port 15 so that the end of the tube 54 and pulley 58 is on the interior of the vessel 12. The outwardly extending portion 42 of the hoist 10 is then anchored to suitable structural members. Typically, and as previously described with reference to FIG. 1, the bar 84 is anchored with suitable clamps 88 to pipes or bars which are in turn clamped to adjacent hand rails. The control cable 72 is fed into the vessel interior through another suitable port 15 from which the hoist 10 can be operated.

Figure 7:
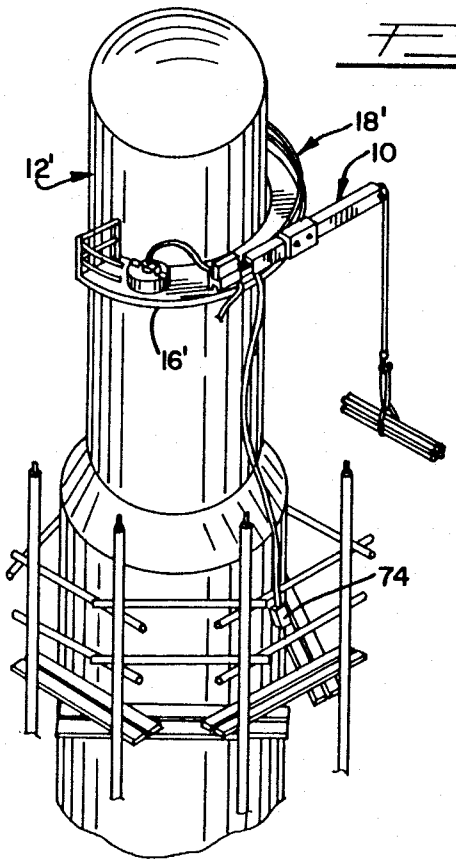
FIG. 7 is a perspective view of the hoist of the present invention shown in use on the exterior of a vessel.

FIG. 7 illustrates another mode of operation wherein the hoist 10 is shown mounted to the exterior of a cylindrical vessel 12'. The hoist 10 is cantilevered over a walkway 16' and is clamped by suitable mechanisms (not illustrated) to the walkway hand rail assembly 18' which is partially broken away to show the position of the hoist 10 on the walkway 16'.

Figure 8:
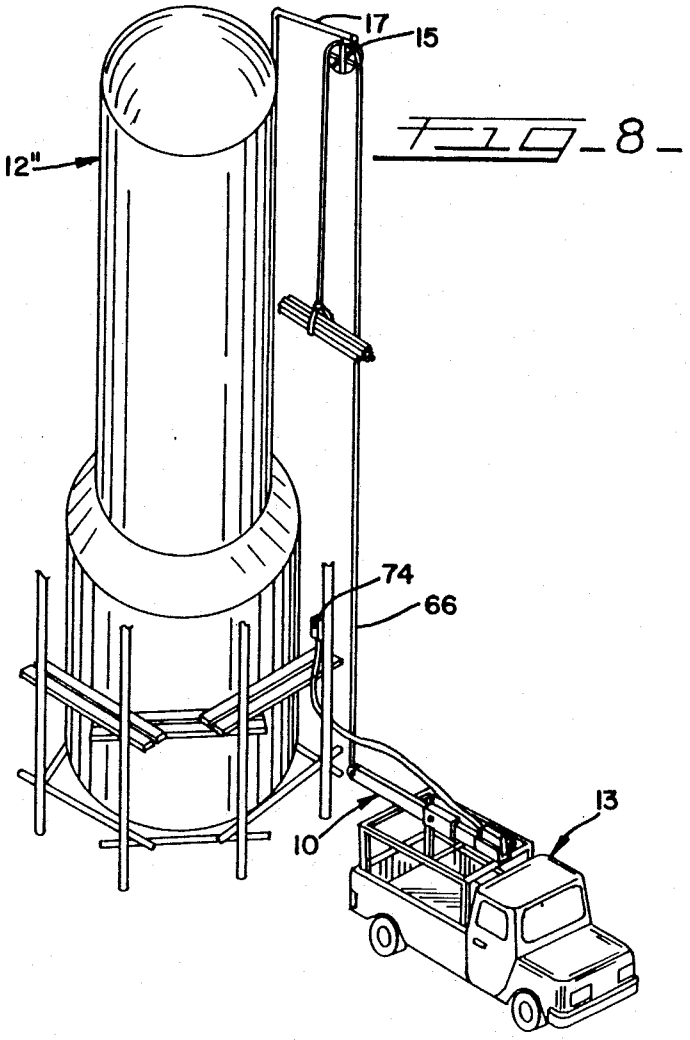
FIG. 8 is a perspective view of the hoist of the present invention shown mounted to a truck adjacent a vessel.

FIG. 8 illustrates the hoist 10 mounted to a truck 13 by suitable clamping mechanisms (not illustrated). The cable 66 from the hoist 10 is run over a sheave 15 carried by a cantilevered member 17 mounted to the top of a vessel 12''.

In both of the modes of operation illustrated in FIGS. 7 and 8, the hoist 10 may be operated from the control pendant 74 maintained at an elevation near the bottom of the vessel.

It will be readily observed from the foregoing detailed description of the invention and from the illustrated embodiments thereof that numerous variations and modifications may be effected without departing from the true spirit and scope of the novel concepts or principles of this invention.

What is claimed is:

1. A hoist for lifting objects inside a vessel having a wall defining a port and having a platform adjacent the exterior of said wall, said hoist comprising:

a frame, said frame including a support portion for extending outwardly from said port adjacent said platform and including a cantilevered portion for extending through, and inwardly from, said port when said hoist is operatively disposed to lift said objects inside said vessel, said frame extending in a generally horizontal plane when the hoist is operatively disposed to lift said objects inside said vessel, said support portion including a round bar fixed to, and laterally extending on each side of, said frame parallel to said horizontal plane for being attached to said platform;

attaching means for attaching said frame support portion round bar to said platform;

a cable extending along said frame from said support portion to said cantilevered portion;

means for guiding said cable through a change in direction on said cantilevered portion to accommodate the hanging of an end of said cable from said cantilevered portion; and a winch operatively engaged with said cable and mounted to said frame support portion for feeding out and for retracting said cable whereby the end of said cable may be raised and lowered inside said vessel.

2. A method for lifting an object from a lower elevation to a higher elevation inside a vessel having a wall defining ports with at least one of said ports being located above said higher elevation and having a platform adjacent the exterior of said wall, said method comprising the steps of:

(A) providing, at said platform, a hoist having (a) a support portion, (b) a cantilevered portion extending from said support portion, (c) an electrically operated winch on said support portion, (d) a hoist cable extending from said winch over the end of said cantilevered portion, and (e) a winch control cable connected to said winch;

(B) positioning said hoist with said cantilevered portion and hoist cable extending through one of said ports;

(C) releasably anchoring said support portion to said platform; and (D) feeding said winch control cable through one of said ports to said lower elevation in the interior of said vessel; and (E) operating said hoist through said winch control cable from inside said vessel to lower said hoist cable to said lower elevation, attaching said object to said hoist cable, and then operating said hoist through said winch control cable to lift said object to said higher elevation.

* * * * *